US008286552B2

(12) United States Patent
Niswonger

(10) Patent No.: US 8,286,552 B2
(45) Date of Patent: Oct. 16, 2012

(54) SCREEN-PRINTING PANEL

(76) Inventor: John O. H. Niswonger, Calabasas, CA (US)

( * ) Notice: Subject to any disclaimer, the term of this patent is extended or adjusted under 35 U.S.C. 154(b) by 51 days.

(21) Appl. No.: 12/821,154

(22) Filed: Jun. 23, 2010

(65) Prior Publication Data

US 2010/0263558 A1 Oct. 21, 2010

Related U.S. Application Data

(63) Continuation-in-part of application No. 11/827,729, filed on Jul. 13, 2007, now Pat. No. 7,752,963, and a continuation-in-part of application No. 12/409,522, filed on Mar. 24, 2009, which is a continuation-in-part of application No. 11/827,729, filed on Jul. 13, 2007, now Pat. No. 7,752,963.

(60) Provisional application No. 61/219,408, filed on Jun. 23, 2009, provisional application No. 60/830,712, filed on Jul. 13, 2006, provisional application No. 61/070,702, filed on Mar. 24, 2008, provisional application No. 61/130,362, filed on May 31, 2008, provisional application No. 60/830,712, filed on Jul. 13, 2006, provisional application No. 61/312,671, filed on Mar. 11, 2010, provisional application No. 61/231,012, filed on Aug. 3, 2009.

(51) Int. Cl.
*B05C 17/06* (2006.01)
*B41C 1/14* (2006.01)

(52) U.S. Cl. ..... 101/127.1; 101/128.4

(58) Field of Classification Search ..... 101/114, 101/127, 127.1, 129; 38/102.1–102.91; 160/327–330, 368.1
See application file for complete search history.

(56) References Cited

U.S. PATENT DOCUMENTS

| | | | | |
|---|---|---|---|---|
| 4,249,589 | A * | 2/1981 | Loeb | 160/368.1 |
| 4,462,174 | A * | 7/1984 | Messerschmitt | 38/102.1 |
| 5,113,611 | A * | 5/1992 | Rosson | 38/102.7 |
| 5,911,266 | A * | 6/1999 | Jacobs | 160/368.1 |
| 2003/0075258 | A1 * | 4/2003 | Zhang et al. | 156/93 |
| 2005/0196585 | A1 * | 9/2005 | Yu | 428/102 |
| 2009/0145559 | A1 * | 6/2009 | Glasl et al. | 160/273.1 |

* cited by examiner

*Primary Examiner* — Ren Yan
(74) *Attorney, Agent, or Firm* — Ronald L. Rohde

(57) ABSTRACT

A screen-printing panel comprising a locking strip sewn to screen-printing mesh is described. The mesh along an edge of the panel is folded around the locking strip and secured using a line of stitching. A gap between the end of the locking strip and the edge of the mesh contributes to corner softening. Another gap between the end of the stitching and the end of the locking strip also contributes to corner softening. Locking strips have various cross sections including rectangular, triangular, and complex curves. Two colors of thread may be used to aid in orienting the panel. An adhesive may be used to hold the mesh to the locking strip for convenience during handling and sewing.

13 Claims, 14 Drawing Sheets

SCREEN-PRINTING PANEL

CROSS-REFERENCE TO RELATED APPLICATIONS

This application claims priority and benefit of U.S. provisional patent application No. 61/219,408 titled "SILK-SCREEN PANEL," filed on Jun. 23, 2009.

This application is a continuation in part of and claims priority and benefit of U.S. patent application Ser. No. 11/827,729, titled "APPARATUS AND METHOD FOR SCREEN TENSIONING," filed on Jul. 13, 2007, now U.S. Pat. No. 7,752,963 which in turn claims priority and benefit of U.S. provisional patent application No. 60/830,712 titled "Improved Apparatus and Method for Screen Tensioning," filed on Jul. 13, 2006.

This application is a continuation in part of and claims priority and benefit of pending U.S. patent application Ser. No. 12/409,522, titled "PIVOTING LOCKING STRIP SYSTEM AND APPARATUS FOR SILKSCREEN FRAME," filed on Mar. 24, 2009, which in turn claims priority and benefit of U.S. provisional patent application No. 61/070,702 titled "Pivoting locking strip system and apparatus for silkscreen frame," filed on Mar. 24, 2008, and U.S. provisional patent application No. 61/130,362 titled "Panel and mesh for pivoting locking strip and silkscreen system," filed on May 31, 2008. U.S. patent application Ser. No. 12/409,522 is also a continuation in part of pending U.S. patent application Ser. No. 11/827,729, titled "APPARATUS AND METHOD FOR SCREEN TENSIONING," filed on Jul. 13, 2007, now U.S. Pat. No. 7,752,963 which in turn claims priority and benefit of U.S. provisional patent application No. 60/830,712 titled "Improved Apparatus and Method for Screen Tensioning," filed on Jul. 13, 2006.

This application claims priority and benefit of U.S. provisional patent application No. 61/312,671 titled "Roller Frame Stretcher," filed on Mar. 11, 2010, and U.S. provisional patent application No. 61/231,012, titled "Silkscreen Frame" filed on Aug. 3, 2009. All of the above applications are incorporated herein by reference in their entirety.

FIELD OF THE APPLICATION

The present application relates generally to silkscreen printing and screen-printing apparatus, and more particularly to screen-printing panels.

DESCRIPTION OF RELATED ART

Silkscreen printing has been used for centuries. The terms "screen-printing" and "silkscreen printing" are generally used interchangeably. Historically, silk was used as a screen-printing mesh. Presently, synthetic threads are commonly used in the screen-printing mesh. Examples of synthetic threads for mesh include polyester, nylon, or stainless steel, which are in general use in the screen-printing industry. There are many materials both synthetic and natural that are used for constructing mesh including plastics, fabric, metals, paper, animal, and plant products. Silkscreen has come to refer to screen-printing mesh that has been fabricated using any of these materials. Screen-printing mesh also includes a laminated combination of these materials and/or various emulsions.

Generally, tensioning systems for mounting screen-printing mesh on frames are capable of handling mesh across the wide range of weight and texture. One method for tensioning and using mesh is to glue mesh to a frame while the mesh is held under tension. Unfortunately, the glues can degrade due to exposure to chemicals during printing. Moreover, stretched frames take up space during storage. Removing mesh for reuse of the frame destroys the mesh and typically involves the use of environmentally hazardous solvents. Some of these glues and solvents are being outlawed in some jurisdictions and may become unavailable for use anywhere.

Reusable frames are also used for tensioning mesh. One method of constructing a reusable frame is to use a roller including a longitudinal groove in the shape of an inverted "T" to hold the mesh. A locking strip is used to secure the fabric into the groove. The fabric is pushed into the groove from the top. The locking strip is inserted into the groove from an end of the groove and pushed or pulled to slide it lengthwise through the groove to secure the fabric. The locking strip is extracted from the groove by sliding it the lengthwise out of an end of the groove to release the fabric. Generally, the groove extends the length of the roller. Unfortunately, it is difficult to work the locking strip along the length of the groove and the locking strip catches on the fabric during insertion and removal. Extreme forces are often exerted on the mesh at the corners of the roller frame during tensioning. The extreme forces result from tension applied at right angles near the corners. These forces result in tearing the mesh. Other types of silkscreen frames that are used for tensioning the mesh have similar problems with corner forces. Complex "corner softening" procedures and costly accessories are used with minimal success to reduce the forces and resultant tearing at the corners.

SUMMARY

In some embodiments, a screen-printing panel for mounting on a frame includes a locking strip having a first surface, a second surface, a length, and a width. An adhesive may be disposed on the first surface along a portion of the length of the locking strip. An end of the locking strip includes a region free of the adhesive. A mesh is cut to a rectangular shape having substantially straight edges. An edge of the mesh is folded around an edge of the locking strip to position the edge of the mesh adjacent the first and second surface of the locking strip. A length of the edge of the mesh is greater than the length of the locking strip plus four times the width of the locking strip. The locking strip may be secured to the mesh using the adhesive. Stitching is sewn along a portion of the length of the locking strip and configured to secure the folded mesh to the first surface and the second surface of the locking strip. The locking strip may have a triangular cross section. The stitching may include an upper stitching having a first color and a lower stitching having a second color.

In some embodiments, a method for making a screen-printing panel includes cutting a mesh into a rectangle having substantially straight edges. The method further includes applying an adhesive to a portion of a first surface of a locking strip, and attaching the locking strip along an edge of the mesh using the adhesive. The ends of the locking strip may have an uncoated region free of adhesive. The mesh is folded around the locking strip to position the mesh adjacent to a second surface of the locking strip. The mesh is then sewn to the first and second surfaces of the locking strip using stitching through the locking strip. The locking strip may be shorter than the edge of the mesh and the stitching may be shorter than the locking strip.

In some embodiments, a screen-printing panel for tensioning on a frame includes a locking strip and a mesh cut to a rectangular shape having substantially straight edges. An edge of the mesh is wrapped around an edge of the locking strip and there is a gap between an end of the locking strip and an edge of the mesh perpendicular to the locking strip. Upper stitching is used to secure the mesh to an upper surface of the locking strip and penetrate the locking strip. The length of the upper stitching is less than the length of the locking strip. Lower stitching is used to engage the upper stitching and to secure the mesh to a lower surface of the locking strip. The color of the lower stitching may be different from the color of the upper stitching. The locking strip may include a thick edge and a thin edge, and a fold of the stitched mesh between the upper stitching and the lower stitching may be wrapped around the thick edge.

BRIEF DESCRIPTION OF THE DRAWINGS

FIG. 11 is a cross section view of a section of the screen-printing panel and the locking strip configured for insertion into a slot of a frame.

DETAILED DESCRIPTION

The present disclosure includes a screen-printing panel comprising a locking strip sewn to screen-printing mesh. The mesh along an edge of the panel is folded around the locking strip. The folded mesh is secured to the locking strip using a line of stitching sewn through the locking strip. The stitching secures the mesh to one or both sides of the locking strip. Two colors of thread may be used to aid in orienting the panel right-side-up. A gap between the end of the stitching and the locking strip contributes to corner softening. Another gap between the end of the locking strip and the edge of the mesh also contributes to corner softening. Locking strips having various cross sections are used. An adhesive may be used to hold the mesh to the locking strip for convenience during handling and sewing.

In use, locking strips are sewn (or stitched) to the periphery of the mesh to make the screen-printing panel. The stitched locking strip and folded mesh are inserted into locking strip grooves around the periphery of a screen-printing frame. The locking strip grooves may be disposed in a movable portions of the frame. The movable portions of the frame may then be drawn apart, or away from the center of the frame, for stretching the panel. Alternatively, the locking strip groves are disposed in rollers that are rotated to apply tension to the screen-printing panel. Color-coded thread may be used to indicate proper orientation of the locking strip during insertion into the locking strip groove.

Figure 1:
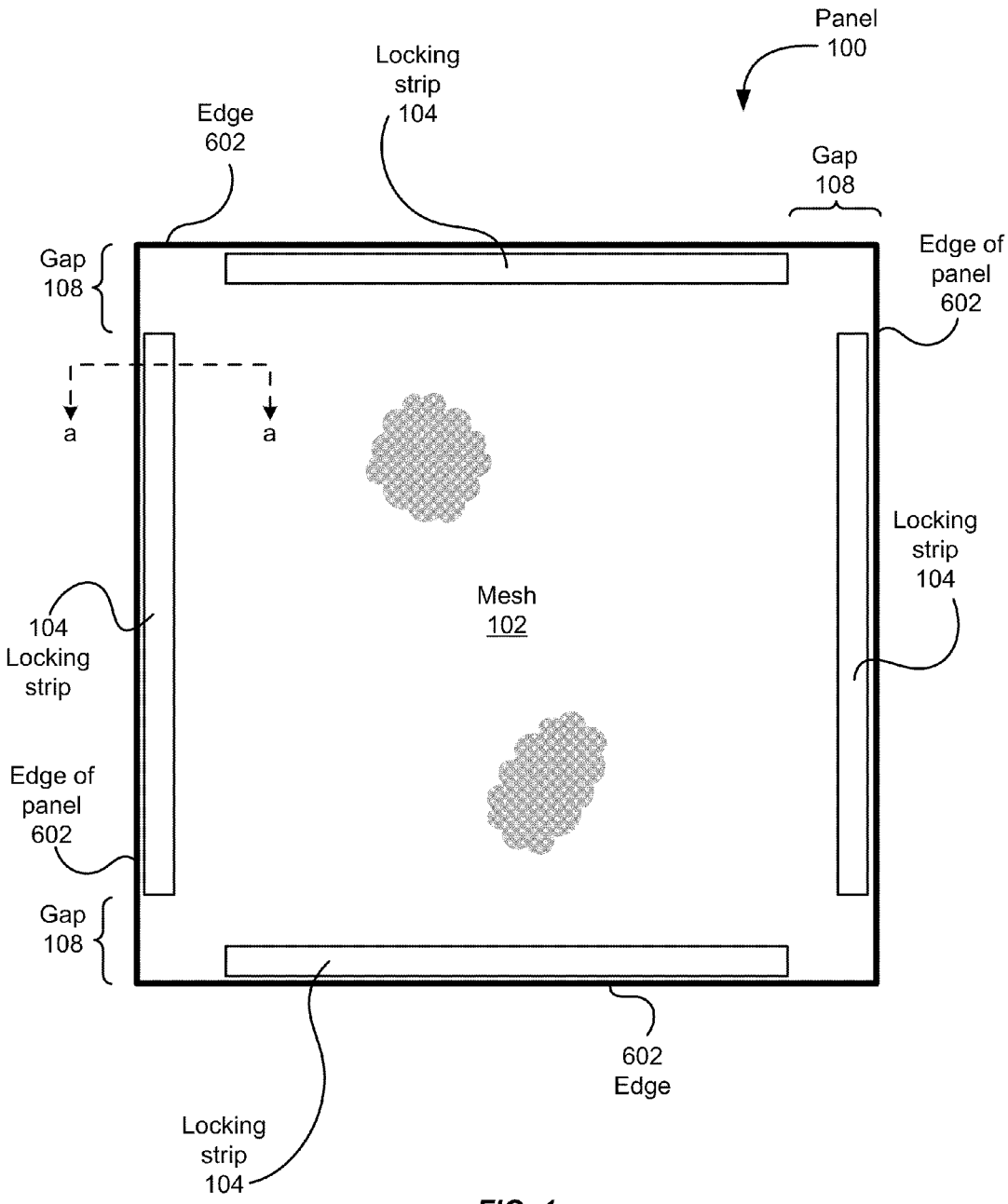
FIG. 1 is a top plan view of an embodiment of a screen-printing panel, in accordance with aspects of the technology.

FIG. 1 is a top plan view of an embodiment of a screen-printing panel 100, in accordance with aspects of the technology. The screen-printing panel 100 of FIG. 1 is fabricated using fabric or mesh 102. The panel 100 includes mesh 102 that has been cut to a predetermined size and shape. The size and shape of the mesh 102 may be optimized for the type of mesh and anticipated stretch under an expected tension. In various embodiments, the mesh 102 is fabricated using materials such as polyester, poly propylene, nylon, fabric, cloth, silk, plastic, synthetic threads, natural threads, paper, fabric, metals and/or the like.

The panel 100 includes a locking strip 104 disposed along an edge 106 of the mesh 102. The edges 106 of the mesh 102 may be straight. Securing the locking strips 104 along straight edges 106 may simplify manufacturing of a screen-printing panel 100 and attaching the panel 100 to a frame (not shown). The locking strip 104 may be secured to the mesh 102 temporarily using an adhesive (illustrated elsewhere herein) between the locking strip 104 and the mesh 102 for handling, as illustrated elsewhere herein. The locking strip 104 may then be sewn to the mesh 102 for a more permanent attachment. In some embodiments, an emulsion is applied to a surface of the mesh 102 before securing the locking strip 104 to the mesh 102. The mesh 102 may include multiple laminations of material and/or emulsion.

A locking strip 104 may be disposed along each edge 106 of the mesh 102. The ends of locking strips 104 of FIG. 1 do not extend to the respective edges 106 of the mesh 102 that are perpendicular to the locking strip. A gap 108 is provided between the end of the locking strip 104 and the edge 106 perpendicular to the locking strip 106. An edge that is perpendicular to adjacent to an end of a locking strip but perpendicular to that locking strip may be referred to as a perpendicular edge. The gap 108 permits flex of the mesh 102 and reduces tension in the corners of the panel 100. This allows "softening" of the corners of the panel 100. Softening is a technique for reducing tension on the mesh 102 near corners of the panel 100 to prevent tearing of the corners when the panel 100 is stretched in a frame. A distance between the end of the locking strip 104 and the edge 106 of the mesh 102 for the gap 108 may be about 0.5, 1, 2, 3, 4, 5, 6, 7, 8, or more inches. The gap 108 may be a uniform distance or may vary between edges 106 or locking strips 104. In some embodiments, the locking strip 104 includes two co-linear sections. The two sections may be separated by a space (not shown) in about the middle such that the panel 100 may be folded between the two sections for shipping. In some embodiments, the locking strip 104 includes three or more co-linear sections similarly separated for folding. The gap 108 may also represent a gap between the end of the locking strip 104 and a screen-printing frame member (not shown). Thus, an internal distance between two opposing frame members may be greater than the length of the locking strip 104. That is, a gap 108 between the each end of the locking strip 104 and the respective frame member that is perpendicular to the end of the locking strip 104 may be about 0.5, 1, 2, 3, 4, 5, 6, 7, 8, or more inches.

Figure 2:
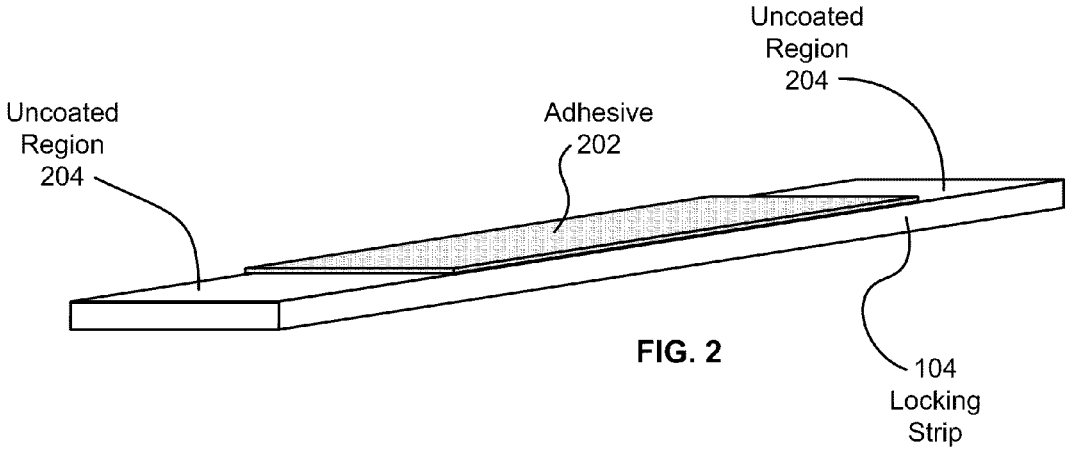
FIG. 2 is a perspective view of a locking strip of FIG. 1.
Figure 3:
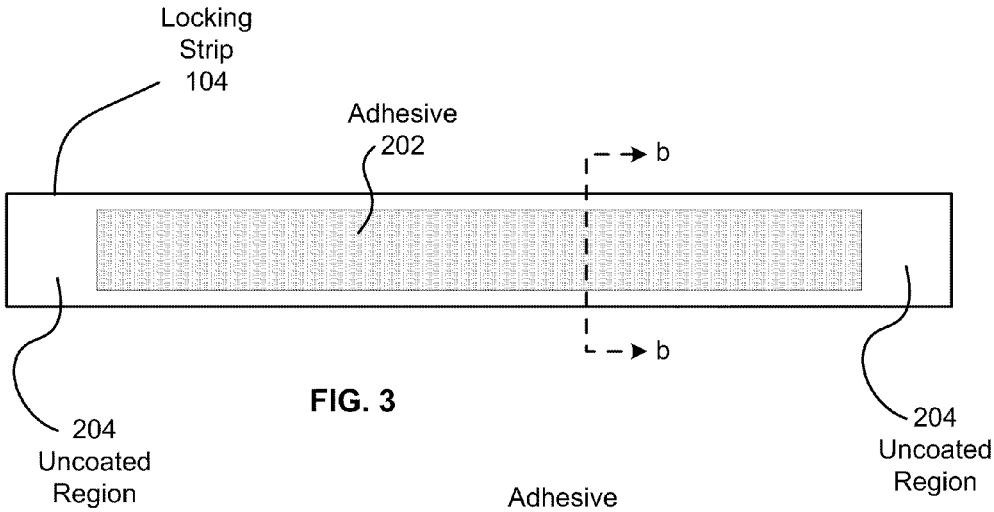
FIG. 3 is a top plan view of the locking strip of FIG. 2.

FIG. 2 is a perspective view of the locking strip 104 of FIG. 1. FIG. 3 is a top plan view of the locking strip 104 of FIG. 2. The locking strip 104 of FIGS. 2 and 3 is an elongated, narrow, flat, semi-rigid strip of flexible material. In various embodiments, the locking strip 104 is fabricated using materials including poly propylene, poly ethylene, poly ester, PVC, ABS, plastic, aluminum, fiber glass, rubber, carbon fiber, and/or the like. The locking strip 104 is configured to be inserted into a slot in a silkscreen frame (illustrated elsewhere herein) for securing the panel 100 to the frame. Additional details of a silkscreen frame may be found in U.S. patent application Ser. No. 11/827,729, U.S. provisional patent application No. 61/231,012, and U.S. provisional patent application No. 61/312,671.

The locking strip 104 of FIGS. 2 and 3 includes an optional adhesive 202 disposed on a first surface the locking strip 104. Each end of the locking strip 104 of the locking strip 104 may include an uncoated region 204 on the first surface of the locking strip 104 where no adhesive 202 is applied. The uncoated region 204 may allow the mesh 102 to slip relative to the locking strip 104, thus, contributing to corner softening. The uncoated region 204 may include 0.25, 0.375, 0.5, 0.75, 1, 1.25, 1.5, 1.75, 2, 3, 4, 5, 6, 8, or more inches of the ends of the locking strip 104. While the adhesive 202 is shown in FIGS. 2 and 3 as being applied long a continuous region, the adhesive 202 may be applied to the first surface of the locking strip 104 discontinuously. That is, there may be one or more gaps in the adhesive 202 along the surface of the locking strip 104. In various embodiments, the adhesive includes glue, tape having adhesive on two sides (double sticky tape), tape having adhesive on one side (single sided tape), contact cement, contact glue, glue, a strip of hook material used in a latch and hook connector such as Velcro, museum tack, tacking material, and/or the like. The adhesive 202 may be water based or organic based. In some embodiments, the adhesive is configured for removal using solvents, such as water and/or water based solvents. Generally, the adhesive is for holding the mesh to the locking strip for handling and sewing. The adhesive may not be necessary during stretching the mesh on a frame or printing.

Figure 4:
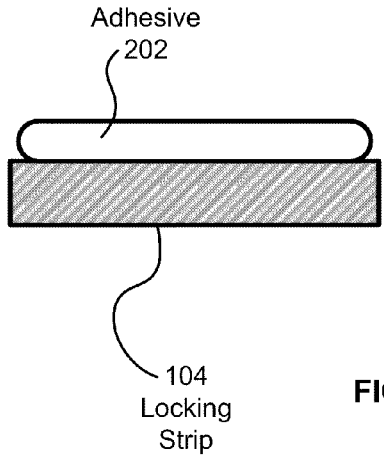
FIG. 4 is a cross section view of the locking strip taken along line b-b of FIG. 3.

FIG. 4 is a cross section view of the locking strip 104 taken along line b-b of FIG. 3. The locking strip 104 of FIG. 4 illustrates the adhesive 202 applied to a first surface of the locking strip 104. However, adhesive 202 may be applied to the first surface and/or a second surface distal the first surface and/or the edges of the locking strip 104. For example, the locking strip 104 may be entirely coated or dipped in the adhesive. While the cross section of the locking strip 104 illustrated in FIG. 4 is rectangular, various shapes may be used for the cross section including 3 triangular, five sided, six sided, seven sided, eight sided, nine sided, ten sided and cross sections having more than ten sides. Examples of various locking strip cross sections are illustrated elsewhere herein.

Figure 5:
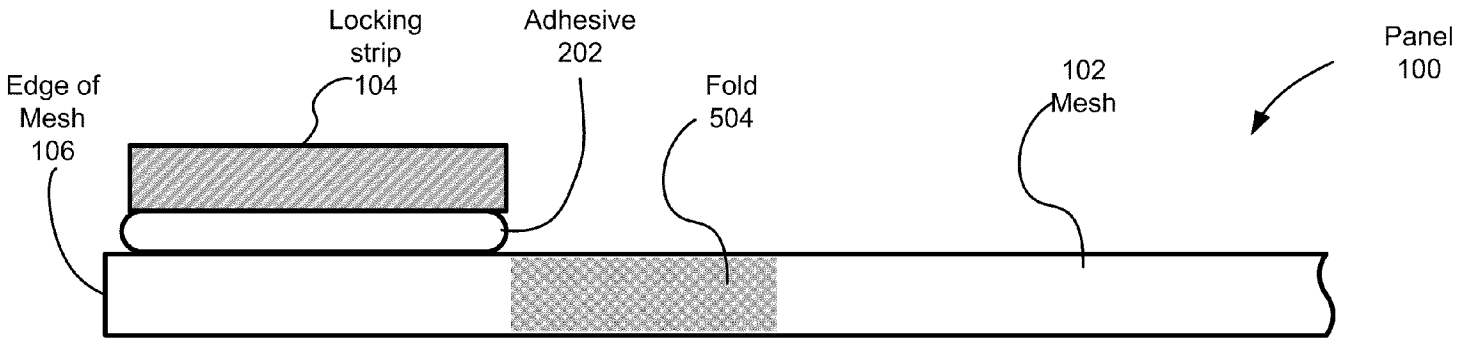
FIG. 5 is a partial cross section view of the panel of FIG. 1 taken along line a-a during assembly of the panel.

FIG. 5 is a partial cross section view of the panel 100 taken along line a-a of FIG. 1 during assembly of the panel 100. The locking strip 104 of FIG. 5 is attached along an edge 106 of the mesh 102 using the adhesive 202. A fold region 504 is illustrated in FIG. 5 where the mesh 102 may be folded inboard of the locking strip, as illustrated elsewhere herein. The adhesive 202 serves as a convenient method for temporarily holding the locking strip in a desired position on the mesh 102 while handling the panel 100. For example, the adhesive 202 may aid in positioning the fold 504 uniformly along an edge of the locking strip. In various embodiments, the adhesive 202 is applied to the mesh 102 instead of (or in addition to) the locking strip 104. See, e.g., U.S. provisional patent application 61/130,362. The size of the adhesive 202 of FIG. 5 and other figures is exaggerated for clarity. Generally adhesive forms a thin film having negligible thickness.

Figure 6:
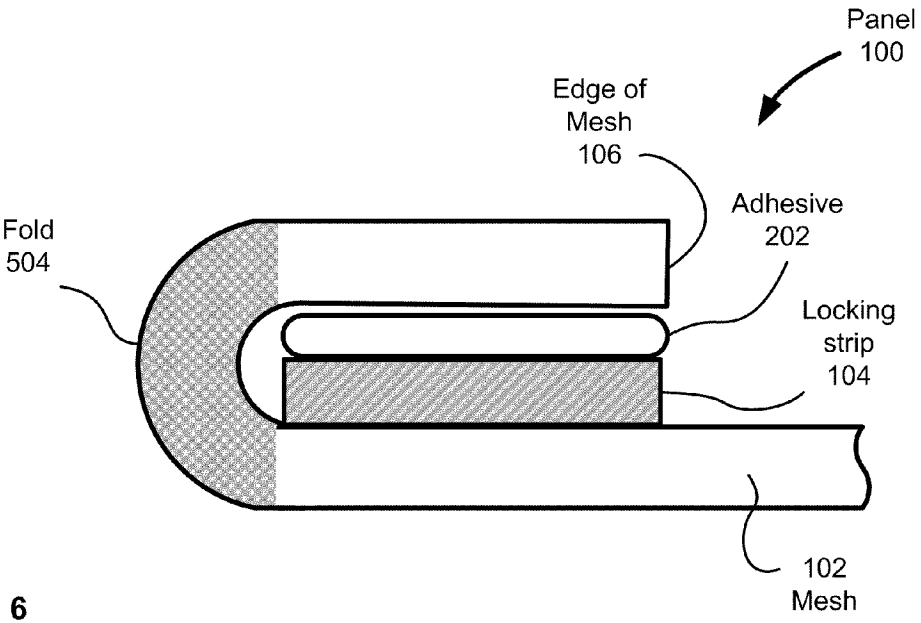
FIG. 6 is a partial cross section view of the panel taken along line a-a of FIG. 1 during assembly of the panel.

FIG. 6 is a partial cross section view of the panel 100 taken along line a-a of FIG. 1 during assembly of the panel 100. FIG. 6 differs from FIG. 5 in that the mesh 102 has been folded in FIG. 6. The edge of the mesh 102 has been folded over, along the fold 504 for sewing as illustrated elsewhere herein. The mesh 102 is adjacent the second surface of the locking strip 104 and distal the adhesive 202 disposed on the first surface of the locking strip 104. The adhesive 202 may also hold the locking strip 104 in the desired position while folding and/or sewing the mesh 102. The "edge" of the mesh 102 may also refer to the region including the fold 504 along the edge 106 that is wrapped around the first and second surface of the locking strip 104.

Figure 7:
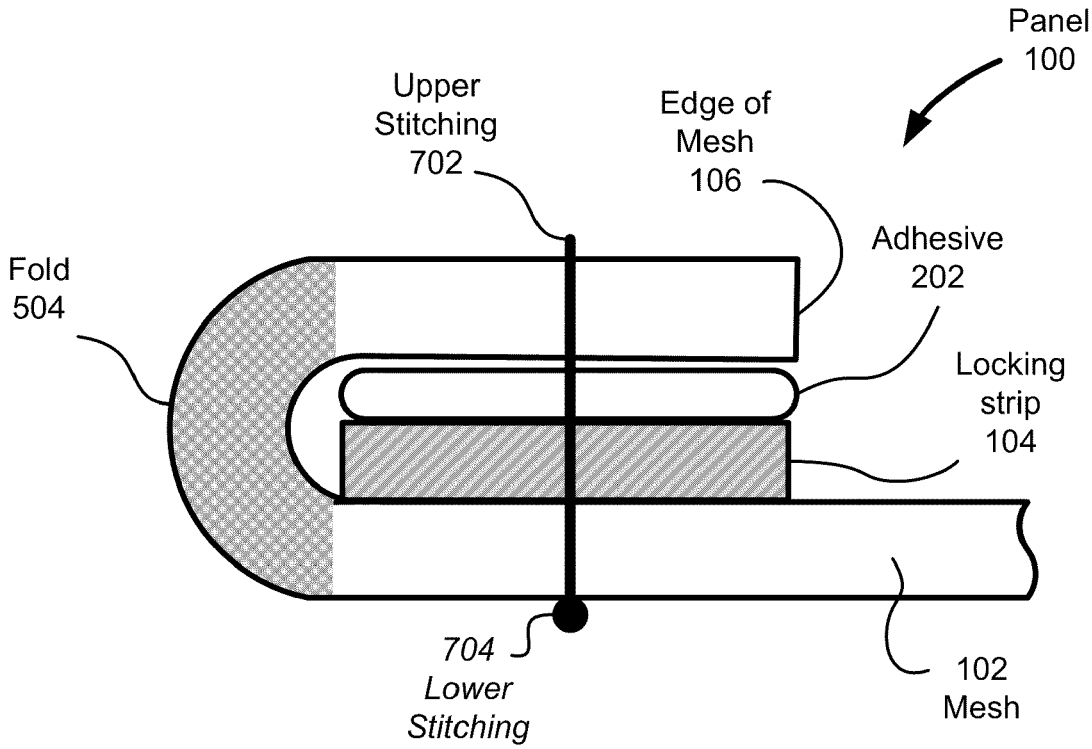
FIG. 7 is a partial cross section view of the panel taken along line a-a of FIG. 1 during assembly of the panel.

FIG. 7 is a partial cross section view of the panel taken along line a-a of FIG. 1 during assembly of the panel 100. FIG. 7 differs from FIG. 6 in that stitching has been applied to the locking strip 104 and mesh 102 to permanently secure the locking strip 104 to the mesh 102. The stitching of FIG. 7 includes an upper stitching 702 and a lower stitching 704. The upper stitching 702 and lower stitching 704 may be referred to collectively as stitching 702/704. The upper stitching 702 may be applied using a needle of a sewing machine. The lower stitching 704 may be applied using a lower bobbin of the sewing machine as is well understood by persons having ordinary skill in use of sewing machines. Alternatively, the upper stitching 702 may be applied using the lower bobbin of a sewing machine and the lower stitching 704 may be applied using the needle of the sewing machine. The upper stitching 702 may be locked to the lower stitching 704 using various types of locking stitches as is well known by persons having ordinary skill in the sewing arts including chain stitch, lockstitch, zigzag, stretch stitching, cross stitching, blind stitching, straight line stitching, cover stitching, overlock stitching, safety stitching, and/or the like. The stitching 702/704 may be applied using an industrial grade sewing machine configured for sewing fabric and mesh to plastic materials. Multiple needles and/or heavy duty needles may be used.

In some embodiments, the upper stitching 702 and the lower stitching 704 are color-coded for ease in identifying the upper side and lower side of the panel 100. That is, the color of the upper stitching 702 uses a first color and the lower stitching 704 uses a second color. This may be accomplished by using the first color thread in the spool for the needle and the second color thread in the lower bobbin of the sewing machine. For example, the upper stitching 702 may be red while the lower stitching 704 may be white. It is further contemplated that in one color coding scheme, the lower stitching 704 may be a uniform color among various size panels 100 while the upper stitching 702 may be use to indicate the size and/or composition of the panel. For example, the lower stitching 704 may be uniformly white among the various panels 100 to indicate a mesh property such as density, while the upper stitching 702 may be red for a first size panel 100, blue for a second size panel 100, yellow for a third size panel and so on. In another example, the lower stitching 704 may be uniformly white among the various panels 100 to indicate a property and/or orientation, while the upper stitching 702 may be red for a first mesh count of a panel 100, blue for a second mesh count of a panel 100, and so on. Alternatively, the upper stitching 702 may be uniform while the lower stitching may be color-coded for various sizes and/or compositions of panels 100. More generally, the upper stitching 702 may be color-coded for a first property of the panes, such as size, while the lower stitching 704 may be color-coded for a second property of the panel, such as mesh count, and vice versa.

Figure 8:
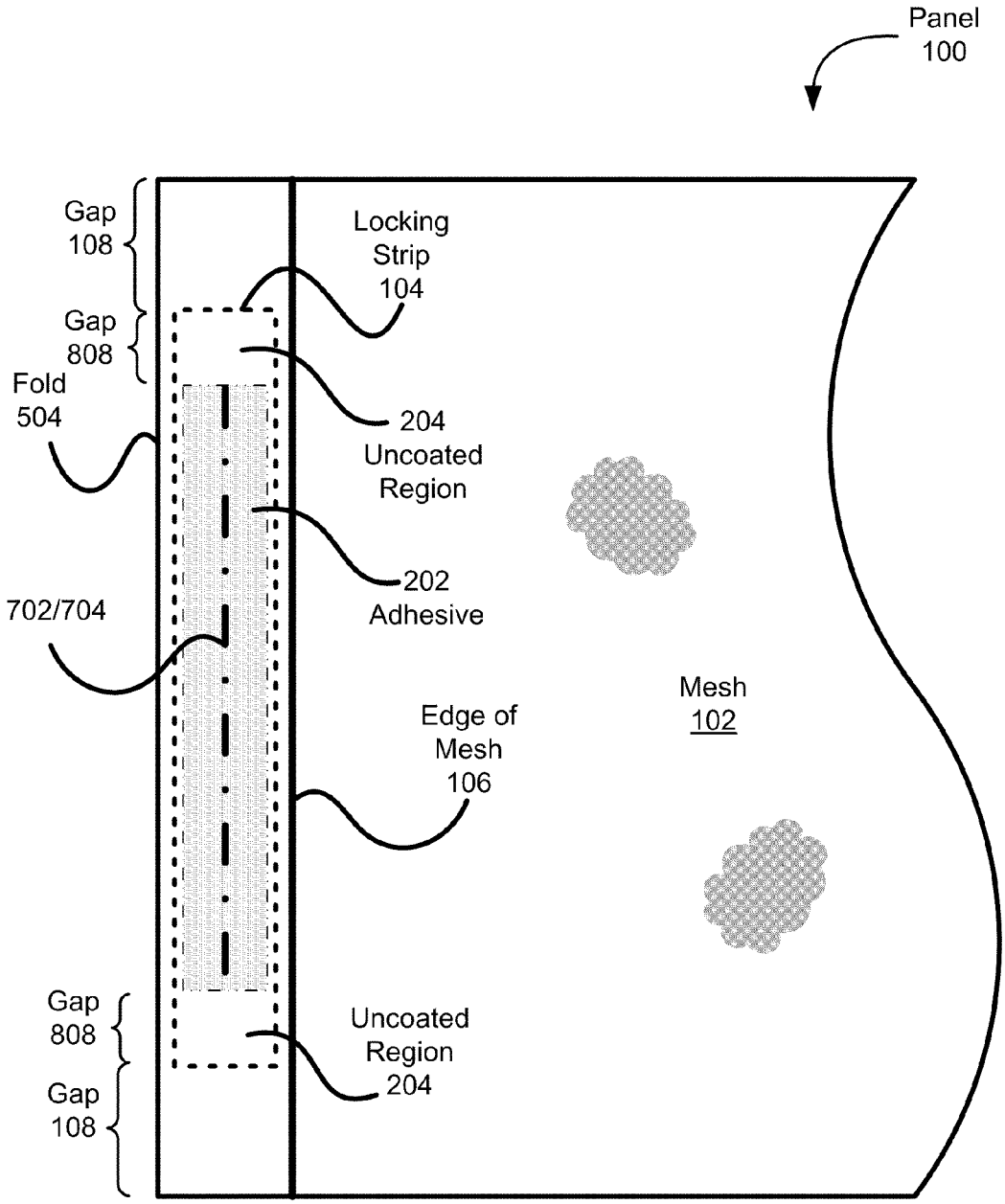
FIG. 8 is a top plan view of a section of a portion of the screen-printing panel of FIG. 1.

FIG. 8 is a top plan view of a section of a portion of the screen-printing panel of FIG. 1. In FIG. 8, the locking strip 104 and adhesive 202 are shown in dotted line to indicate that they are between the folded portions of the mesh. Typically, both the adhesive 202 and the stitching 702/704 are visible through the mesh 102. In FIG. 8, the stitching 702/704 is illustrated as extending from one end of the adhesive 202 to the other. Thus, the adhesive 202 may serve as indicia for placement of the stitching 702/704. However, the stitching 702/704 may extend beyond the ends of the adhesive 202 or may end short of the ends of the adhesive 202.

The stitching 702/704 of FIG. 8 does not extend to the end of the locking strip 104. The stitching 702/704 may end short of the end of the locking strip 104, forming a gap 808 between the end of the stitching 702/704 and the end of the locking strip 104. This gap 808 aids in corner softening. This gap 808 aids in that the fabric of the mesh 102 may slip relative to the locking strip in the region where the mesh 102 is not secured to the locking strip 104. This allows further softening of the corners of the panel 100 while stretching the panel 100. A distance (between the end of the locking strip 104 and the stitching 702/704) for the gap 808 may be about 0.25, 0.375, 0.5, 0.75, 1, 1.25, 1.5, 1.75, 2, 3, 4, 5, 6, 8, or more inches. Alternatively, the stitching 702/704 may extend the length of the locking strip 104, to about the ends of the locking strip 104.

The adhesive 202 may include color to enhance visibility through the mesh 102. In various embodiments, the color of the adhesive 202 may be used to indicate a property of the panel 100 such as panel size, mesh count, mesh weight, and/or material. The color of the adhesive 202 may be used to indicate properties of the locking strip 104, such as length, cross section, material, and/or the like. The adhesive 202 may disposed continuously or discontinuously along the locking strip 104. FIG. 8 illustrates a locking strip 104 along one edge of the panel 100 as would appear upon securing the first locking strip 104 to the panel 100. The process of sewing the locking strip 104 to the mesh 102 may be repeated for locking strips 104 along each remaining edge 106 of the mesh 102 to fabricate the panel 100. The additional locking strips 104 may be secured along the remaining edges 106 of the mesh 102 in sequence.

Figure 9:
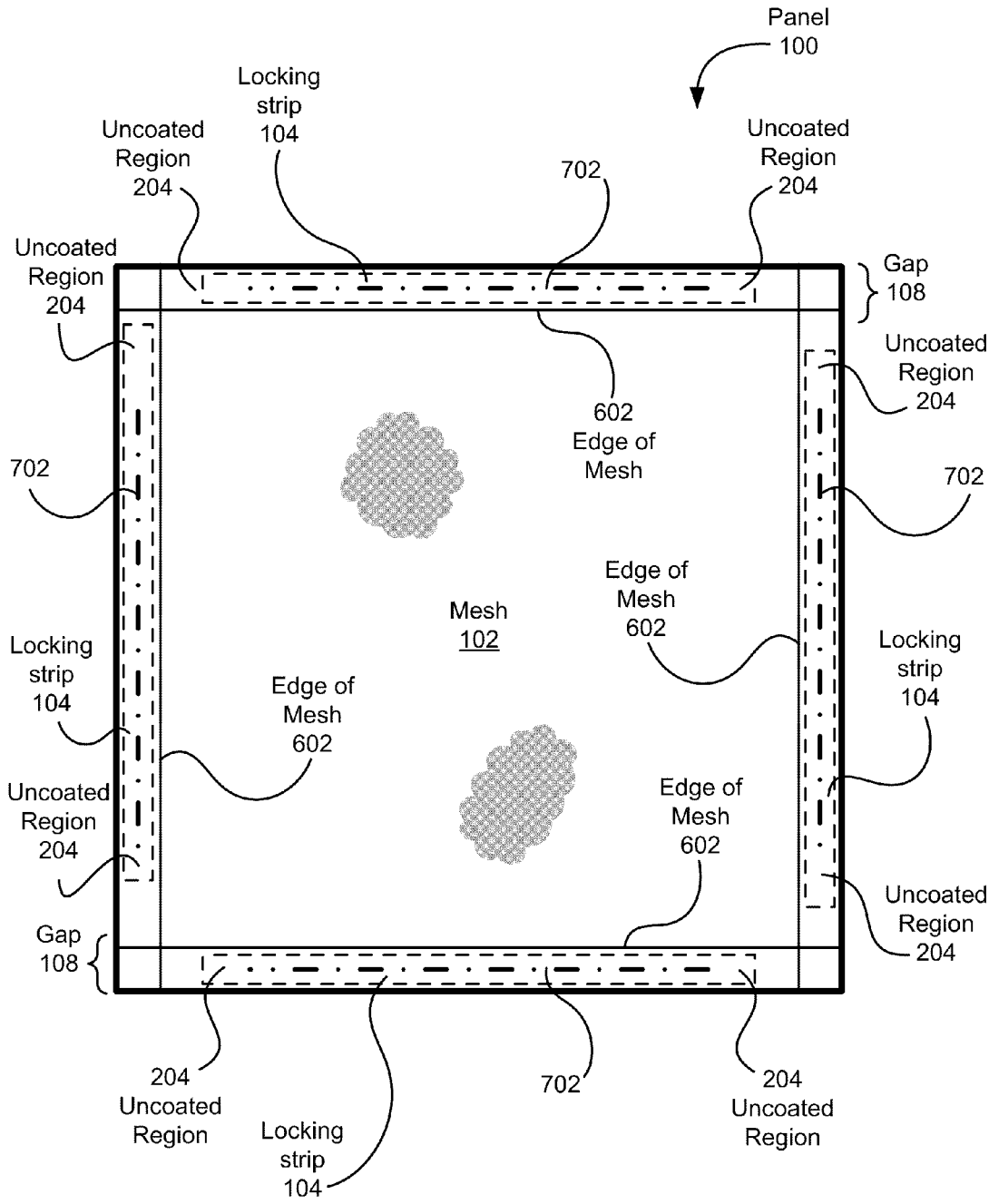
FIG. 9 is a top plan view of the screen-printing panel of FIG. 1.

FIG. 9 is a top plan view of the screen-printing panel 100 of FIG. 1. In FIG. 9, locking strips 104 have been secured along all four edges of the mesh 102. The mesh 102 in the corners of the panel 100 may be secured using tape and/or adhesive before or after installation on a frame to prevent the mesh from expanding and interfering with printing.

Figure 10:
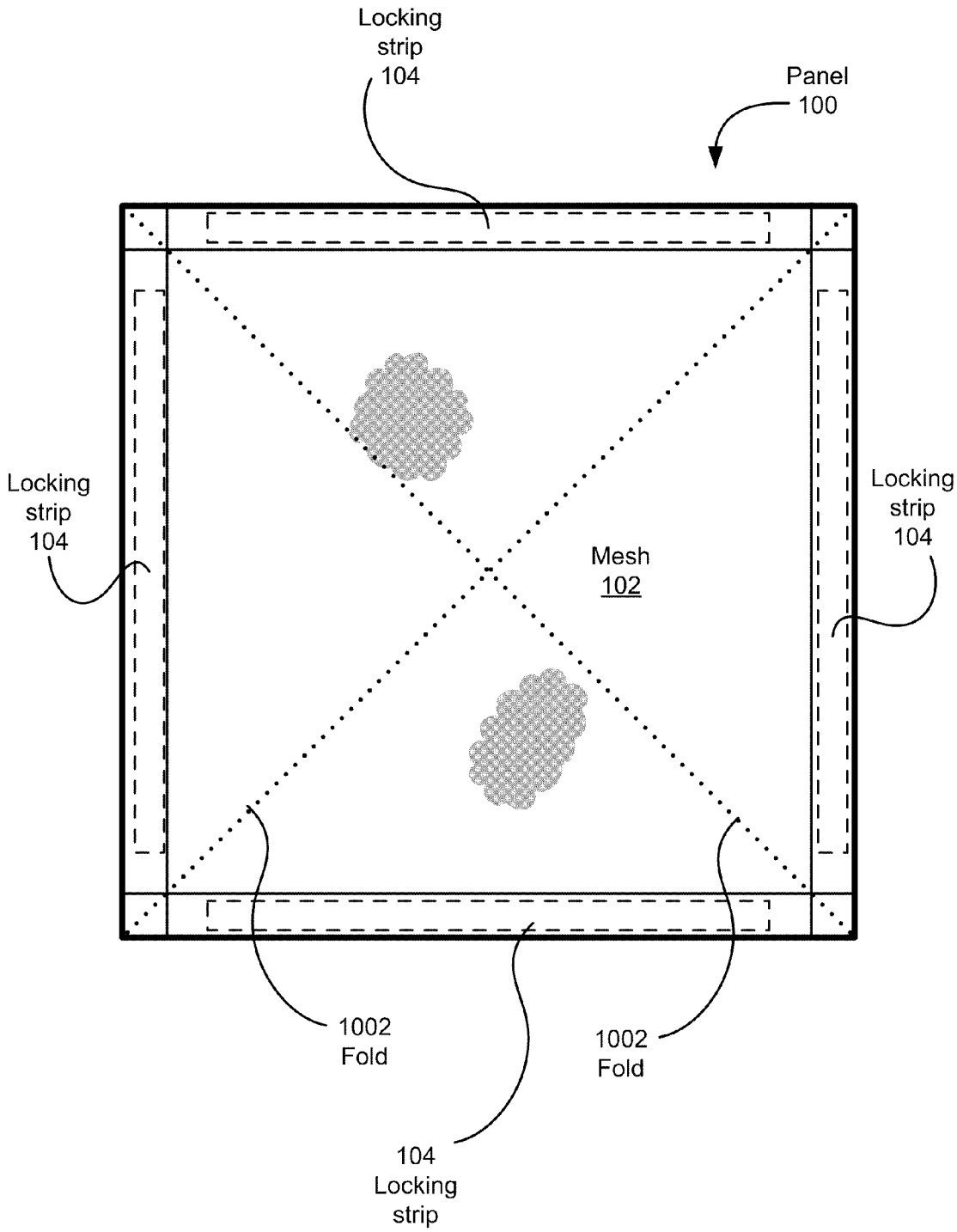
FIG. 10 is a top plan view of the screen-printing panel of FIG. 9.

FIG. 10 is a top plan view of the screen-printing panel 100 of FIG. 9. A dotted line indicates fold lines 1002, each extending diagonally from one corner to an opposite corner of the panel 100 diagonally. Folding the panel 100 in sequence along the two fold lines 1002 allows all four of the locking strips 104 to be placed together in parallel for shipping in a small flat package. The order of folding is not important. Upon folding, the mesh 102 may be rolled around the locking strips 104 for shipping in a tube a little longer than a single locking strip 104.

Figure 11:
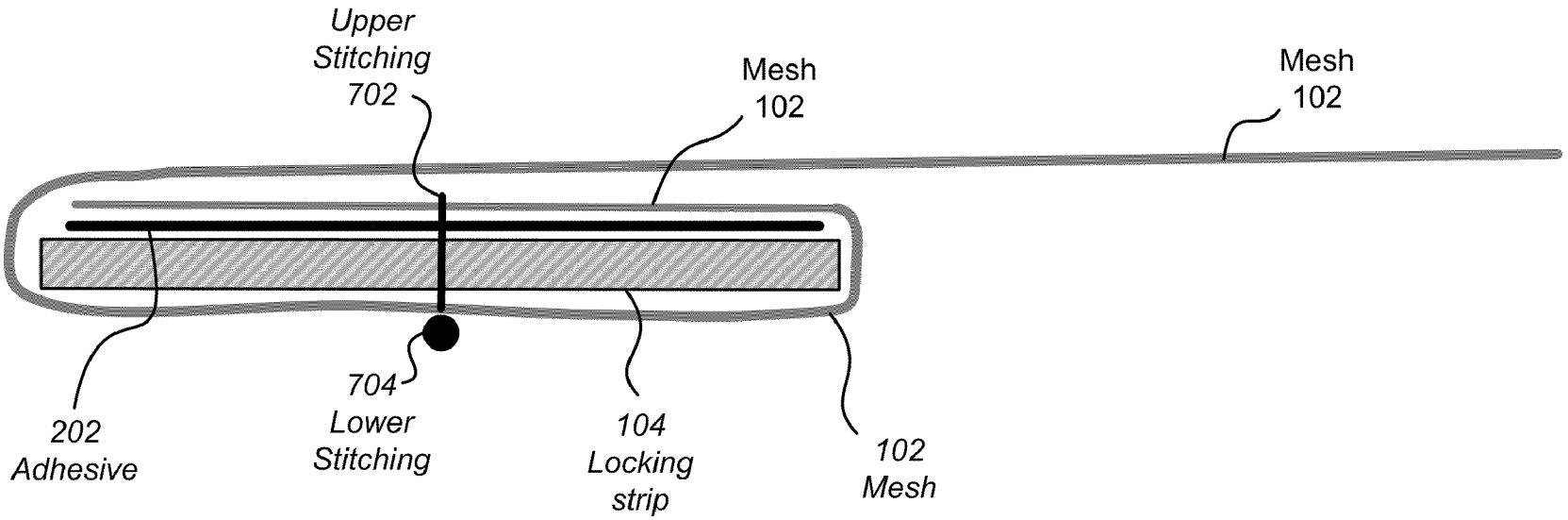
FIG. 11 is a cross section view of a section of a panel and a locking strip.

FIG. 11 is a cross section view of a section of the screen-printing panel 100 and the locking strip 104 configured for insertion into a slot of a frame (shown elsewhere herein). The mesh 102 has been folded once again about the longitudinal axis of the locking strip. The panel 100 may be installed in the frame with the upper stitching 702 oriented upwards with respect to the frame. That is, the upper stitching 702 may be oriented toward the work to be printed using the screen-printing panel. Color coding of the stitching 702 and/or 704 provides a visual aid in orienting the stitching 702 upwards during installation.

Figure 12A:
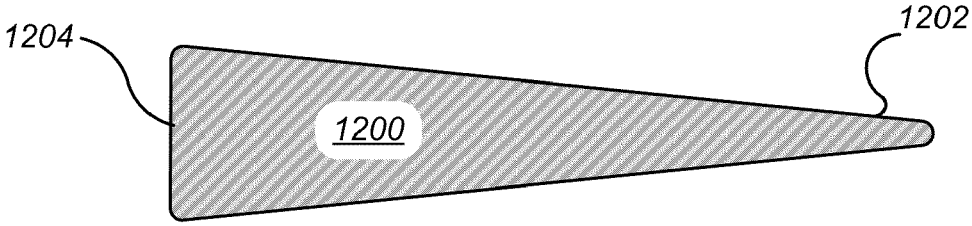
FIG. 12A illustrates an alternative embodiment of the locking strip of FIG. 4 having a triangular cross section to form a triangular locking strip.

FIG. 12A illustrates an alternative embodiment of the locking strip 102 of FIG. 4 having a triangular cross section to form a triangular locking strip 1200. The triangular locking strip 1200 of FIG. 12A differs from the locking strip 104 of FIG. 4 in that the triangular locking strip 1200 has a triangular cross section instead of a rectangular cross section. The triangular locking strip 1200 includes a thick edge 1204 and a thin edge 1202. A thickness of the thick edge 1204 is greater than the thin edge 1202. The corners of the triangular further strip 1200 are somewhat rounded off. However, in practice, such corners may be more rounded off in the manufacturing process.

Figure 12B:
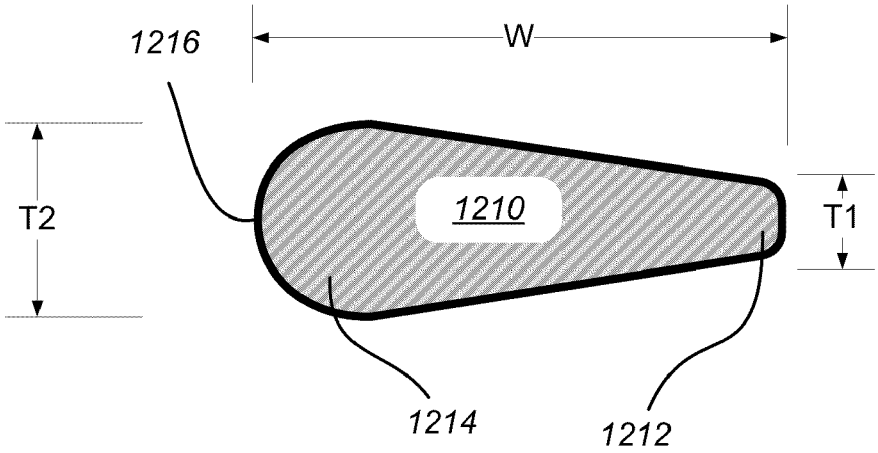
FIG. 12B illustrates a modified triangular cross section of an alternative embodiment of a triangular locking strip.
Figure 13:
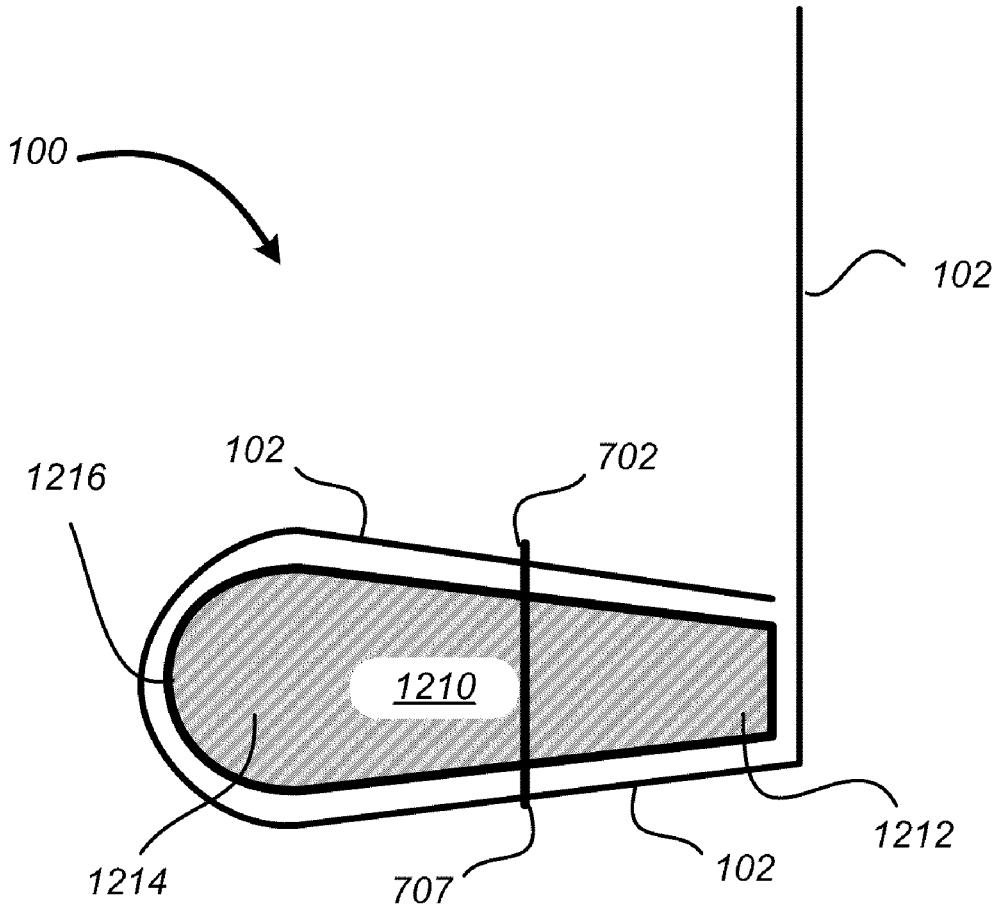
FIG. 13 illustrates an alternative embodiment of a cross section of the mesh panel.

FIG. 12B illustrates a modified triangular cross section of an alternative embodiment of a triangular locking strip 1210. The triangular locking strip 1210 of FIG. 12B differs from the triangular locking strip 1200 of FIG. 12A in that the thick edge 1214 of the triangular locking strip 1210 of FIG. 12B includes a radius 1216. Moreover, the thin edge 1212 of the triangular locking strip of FIG. 12B has been truncated or rounded off more than the thin edge 1202 of FIG. 12A. The cross section of the triangular locking strip 1210 has a width W, a thin edge 1212 having a thickness T1 and a thick edge 1214 that has a thickness of T2. The thickness T2 is greater than the thickness T1. The thickness T1 for the thin edge 1212 may be about 1.5 mm. The thickness T2 for the thick edge 1214 may be about 4 mm. The width W may be about 9.5 mm. A maximum for the thickness T1 is about 2.6 mm. A minimum for the width W is about 7 mm and a maximum for the width W is about 10 mm. A minimum for the thickness T2 is about 2.5 mm FIG. 13 illustrates an alternative embodiment of a cross section of the mesh panel 100. The mesh panel 100 of FIG. 13 differs from the mesh panel 100 of FIG. 7 in that the mesh panel 100 of FIG. 13 includes the triangular locking strip 1210 of FIG. 12B. The adhesive 202 is omitted for clarity. The mesh 102 is illustrated as extending vertically. However, upon insertion, the mesh 102 will be folded around triangular locking strip 1210 to extend toward the left. Tension on the mesh 102 may be exerted toward the left, (as illustrated in FIG. 14D below). The thin edge 1212 is configured for insertion into side a groove of a locking strip groove (as illustrated in FIGS. 14A-D below). The thick edge 1214 is sized for a thickness that is greater than a height of the locking strip side grooves. Thus, the thick edge 1214 cannot enter into the side grooves of a locking strip groove when tension is applied to the mesh 102. The stitching 702/704 secures the mesh 102 to the triangular locking strip 1210 and facilitates handling of the mesh panel 102 during insertion of the triangular locking strip 1210.

FIGS. 14A-D illustrates insertion of the triangular locking strip 1210 and the mesh panel 100 of FIG. 13 into a locking strip groove or slot 1410 in a roller frame 1400. The locking strip slot 1410 includes a first side groove 1402 and a second side groove 1404. The first side groove 1402 and the second side groove 1404 may be about symmetrical in depth D and each have a height "H." Alternatively, the locking strip slot 1410 is asymmetrical. See e.g., U.S. provisional patent application No. 61/231,012.

Figure 14A:
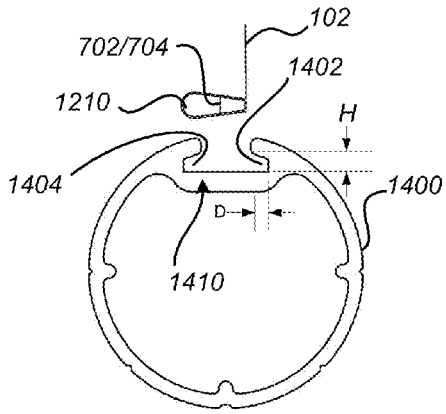
FIGS. 14A-D illustrates insertion of the triangular locking strip and the mesh panel of FIG. 13 into a locking strip groove or slot in a roller frame.
Figure 14B:
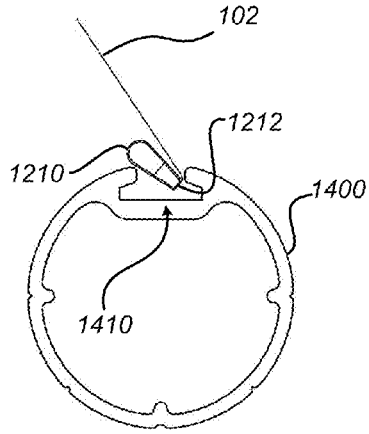
Figure 14C:
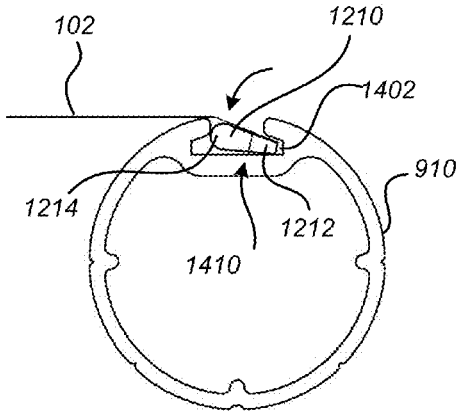
Figure 14D:
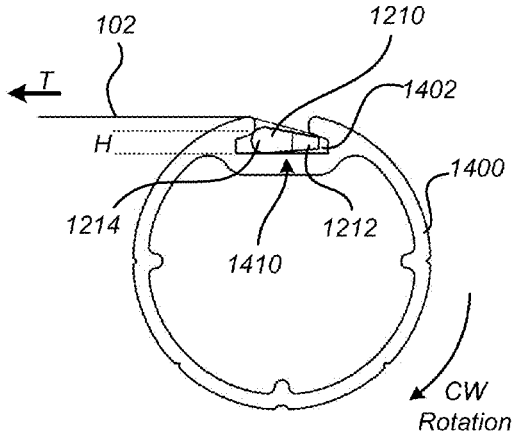

In FIG. 14A, the mesh panel 100, including the triangular locking strip 1210, is positioned above the locking strip slot 1410. In FIG. 14B, the thin edge 1212 of the triangular locking strip 1210 is inserted into the locking strip slot 1410. In FIG. 14C, the thin edge 1212 of the triangular locking strip 1210 is inserted into the first side groove 1402 while the thick edge 1214 of the triangular locking strip 1210 is rotated into the locking strip slot 1410. In FIG. 14D, a tension "T" on the mesh 102 is applied, e.g., through rotation of the roller frame 1400 (clockwise). The tension T forces the thick edge 1214 of the triangular locking strip 1210 against the second side groove 1404. The thickness T2 of the thick edge 1214 is greater than the height H of the second side groove 1404. Thus, the thick edge 1214 is too thick to enter into the second side groove 1404. The stitching 702/704 secures the mesh 102 to the triangular locking strip 1210 and facilitates handling of the mesh panel 102 during insertion of the triangular locking strip 1210 into the locking strip slot 1410. The radius 1216 on the thick edge enhances interference between the triangular locking strip 1210 and an edge of the second side groove 1404. This reduces a tendency of the triangular locking strip 1210 to rotate up and out of the locking strip slot 1410.

Figure 15:
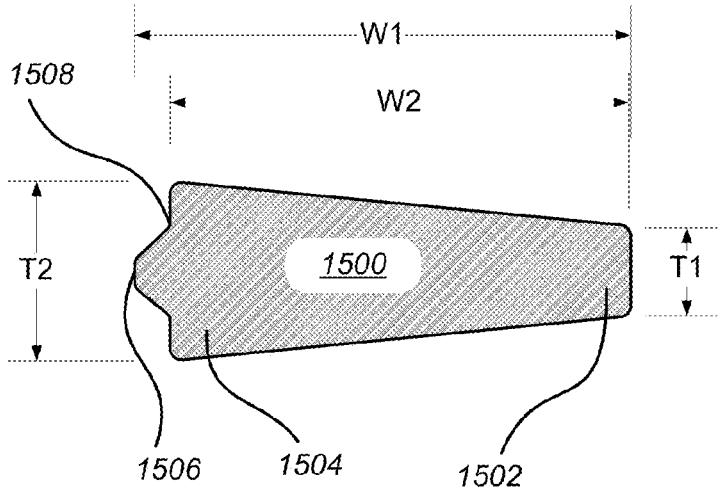
FIG. 15 illustrates details of a cross section of an alternative embodiment of a triangular locking strip.
Figure 16:
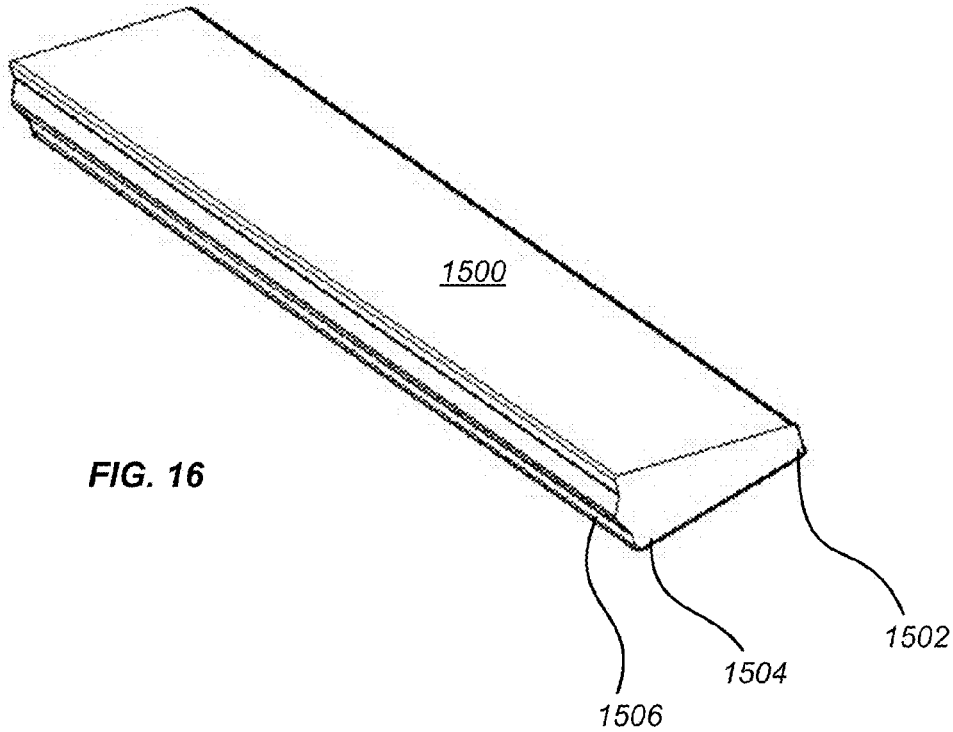
FIG. 16 illustrates a perspective view of the triangular locking strip of FIG. 15.

FIG. 15 illustrates details of a cross section of an alternative embodiment of a triangular locking strip 1500. FIG. 16 illustrates a perspective view of the triangular locking strip 1500 of FIG. 15. The triangular locking strip 1500 includes a thin edge 1502 and a thick edge 1504, similar to the triangular locking strip 1200 and 1210. The triangular locking strip 1500 of FIG. 15 differs from the triangular locking strip 1200 of FIG. 12A in that the triangular locking strip 1500 of FIG. 15 includes a process 1506 extending from the thick edge 1504 and in a plane of the locking strip 1500.

The process 1506 is configured to interfere with the upper edge of the second side groove 1404 to reduce a tendency of the triangular locking strip 1500 to rotate up and out of the locking strip slot 1410. However, a thickness of the process 1506 may be sized for flexibility during insertion of the thick edge 1504 into the locking strip slot 1410. Thus, as the tip of the process 1506 interferes with the edge of the second side groove 1404, the process can flex to admit the thick edge into the locking strip slot 1410. Under tension, the base of the process 1506 interferes with the edge of the second side groove 1404. However, the base of the process 1506 has less flexibility than the tip. Thus, resistance on the process 1506 to rotating out of the slot 1410 while the panel 100 is under tension is greater than the resistance on the process 1506 to rotating into the slot 1410 while the panel 100 is not under tension. The locking strip 1500 further includes a cove 1508 formed between the process 1506 and the upper surface of the locking strip 1500. The cove 1508 is configured to conform to the upper edge of the second side groove 1404 and add additional gripping to retain the locking strip 1500 within the slot 1410.

The cross section of the triangular locking strip 1500 has an overall width W1, a minor width W2. The thin edge 1502 has a thickness T1 and the thick edge 1504 has a thickness of T2. The thickness T2 is greater than the thickness T1. The thickness T1 for the thin edge 1502 may be about 1.5 mm. The thickness T2 for the thick edge 1504 may be about 4 mm. The overall width W1 may be about 9.5 mm. The minor width W2 may be about 9.0 mm. A maximum for the thickness T1 is about 2.6 mm. A minimum for the width W1 is about 7 mm. A maximum for the width W1 is about 10 mm. A minimum for the thickness T2 is about 2.5 mm.

Figure 17A:
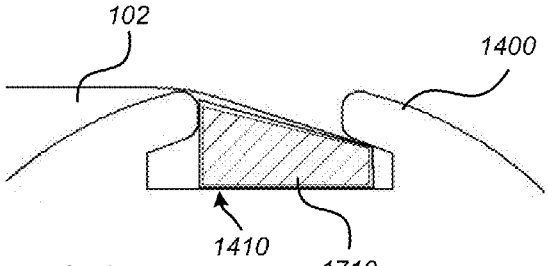
FIGS. 17A-17H illustrate cross sections of various alternative embodiments of locking strips.
Figure 17B:
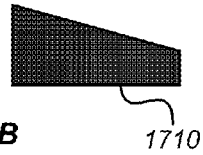

FIGS. 17A-17H illustrate cross sections of various alternative embodiments of locking strips. FIG. 17A illustrates a triangular locking strip 1710 disposed in the locking strip slot 1410. FIG. 17B illustrates the cross section of the triangular locking strip 1710. The triangular locking strip 1710 may be considered to be formed from a right triangle from which a portion of one corner has been rounded off or shortened.

Figure 17C:
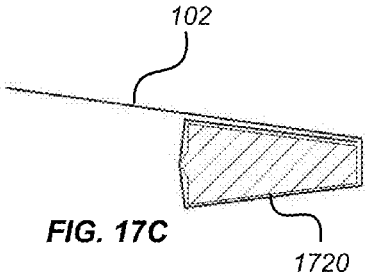
Figure 17D:
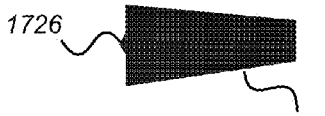

FIG. 17C illustrates another embodiment of a triangular locking strip 1720 and mesh 102 folded around the triangular locking strip 1720. FIG. 17D illustrates a cross section of the triangular locking strip 1720. The triangular locking strip 1720 includes a process 1726 which is similar to the process 1506 of the triangular locking strip 1500. The process 1726 is smaller and less rounded than the process 1506.

Figure 17E:
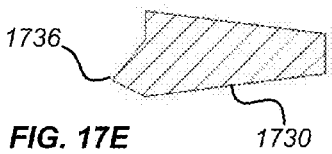

FIG. 17E illustrates a cross section of another embodiment of a triangular locking strip 1730. The triangular locking strip 1730 includes a process 1736 which is similar to the process 1506 of the triangular locking strip 1500. The process 1736 is disposed on the lower portion of the thick edge.

Figure 17F:
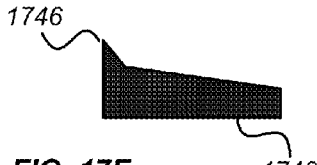

FIG. 17F illustrates a cross section of another embodiment of a triangular locking strip 1740. The triangular locking strip 1740 includes a process 1746 extending near an edge. The process 1746 is configured to prevent entry into the second side groove 1404, similar to the triangular locking strip 1210. However, the process 1746 includes a thinner material comprising a substantial length of the triangular locking strip 1740. The thinner material provides for easier sewing of the mesh 102 to the triangular locking strip 1740 and reduces breaking of sewing needles during penetration of the material of the locking strip 1740.

Figure 17G:
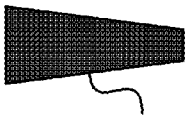
Figure 17H:
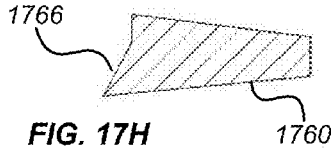

FIG. 17G illustrates a cross section of another embodiment of a triangular locking strip 1750. The triangular locking strip 1750 may be considered to be formed from an acute isosceles triangle from which a portion of one corner has been rounded off or omitted.

FIG. 17E illustrates a cross section of another embodiment of a triangular locking strip 1760. The triangular locking strip 1760 includes a process 1766, which is similar to the process 1506 of the triangular locking strip 1500 and 1736. The process 1766 is disposed on the lower portion of the thick edge.

Figure 18A:
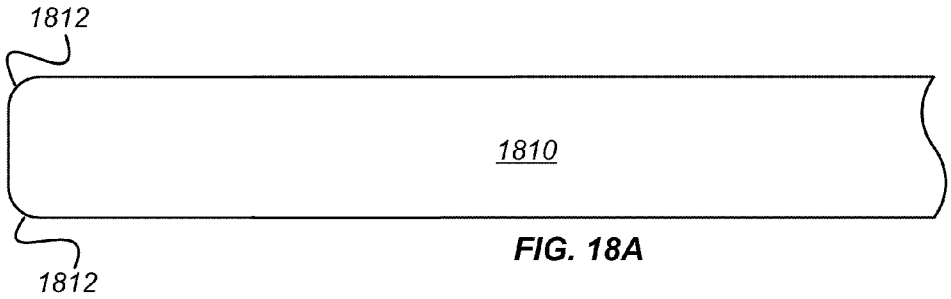
FIGS. 18A-18D illustrate various alternative top plan views of locking strip ends.

FIGS. 18A-18D illustrate various alternative top plan views of locking strip ends, e.g., locking strips 104, 1200, 1210, 1500, 1710, 1720, 1730, 1740, 1750, and 1760. FIG. 18A illustrates a partial top plan view of a rectangular locking strip end 1810. The corners of the rectangular locking strip end 1810 each include a radius 1812. The radiuses 1812 reduce catching and tearing of the mesh 102 during handling of the panel 100.

Figure 18B:
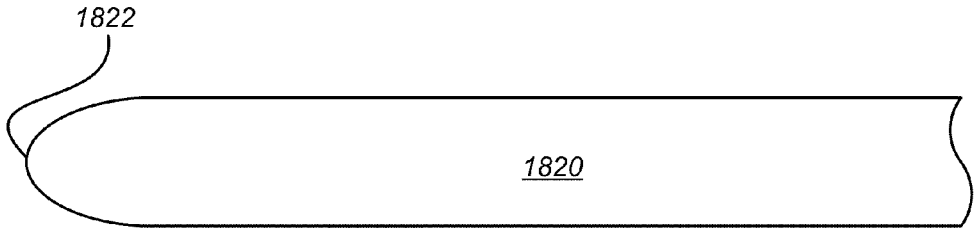

FIG. 18B illustrates a partial top plan view of a rectangular locking strip end 1820. The locking strip end 1820 includes a radius 1822. The radius 1822 reduces catching and tearing of the mesh 102 during handling of the panel 100.

Figure 18C:
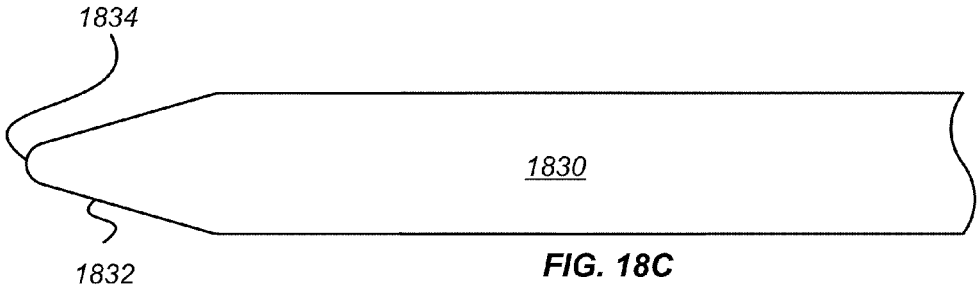

FIG. 18C illustrates a partial top plan view of a rectangular locking strip end 1830. The locking strip end 1830 includes a taper 1832 terminating in a radius 1834. The taper 1832 and the radius 1834 reduce catching and tearing of the mesh 102 during handling of the panel 100. The taper 1842 promotes corner softening.

Figure 18D:
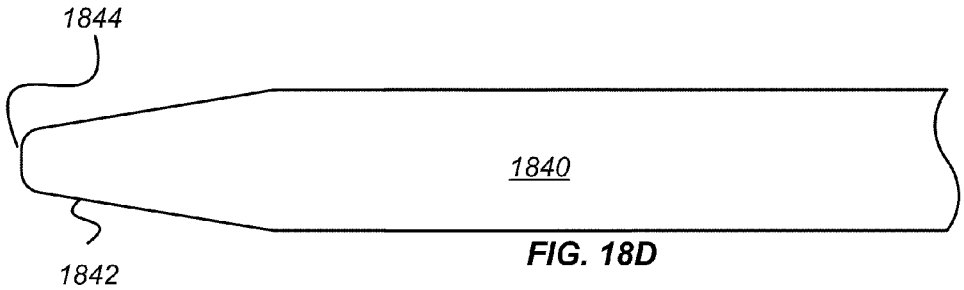

FIG. 18D illustrates a partial top plan view of a rectangular locking strip end 1840. The locking strip end 1840 includes a taper 1842 terminating in a flat 1844. The flat may include corners having a radius. The taper 1832 and the corner radiuses reduce catching and tearing of the mesh 102 during handling of the panel 100. The taper 1842 promotes corner softening.

The embodiments discussed herein are illustrative. As these embodiments are described with reference to illustrations, various modifications or adaptations of the methods and/or specific structures described may become apparent to persons having ordinary skill in the art. For example, the adhesive 102 may be applied to the mesh, see e.g., U.S. patent application Ser. No. 12/409,522. All such modifications, adaptations, or variations that rely upon the teachings of the embodiments, and through which these teachings have advanced the art, are considered to be within the spirit and scope of the present application. Hence, these descriptions and drawings should not be considered in a limiting sense, as it is understood that the present application is in no way limited to only the embodiments illustrated.

What is claimed is:

1. A screen-printing panel for mounting on a frame, the panel comprising:

mesh of a rectangular shape having four substantially straight edges, each edge of the panel comprising:

a locking strip having a first surface, a second surface, two ends, a length, and a width, a length of the edge of the panel being longer than the length of the locking strip plus four times the width of the locking strip;

an adhesive disposed on the first surface of the locking strip along a portion of the length of the locking strip, both ends of the locking strip having an uncoated region of the first surface free of the adhesive;

a fold of mesh along the edge of the panel around an edge of the locking strip to position the mesh adjacent the first and second surface of the locking strip, the first surface of the locking strip secured to the mesh using the adhesive; and a length of stitching sewn through the locking strip and through the mesh adjacent the first and second surface along a portion of the length of the locking strip, the stitching is configured to secure the folded mesh to the first and second surface of the locking strip, the length of the stitching being less than the length of the locking strip and positioned to provide a portion of the first and second surface free of stitching at both ends of the locking strip.

2. The screen-printing panel of claim 1, wherein the edge of the mesh is at least four inches longer than the locking strip.

3. The screen-printing panel of claim 1, wherein the adhesive is disposed on two sides of a length of tape secured to the locking strip.

4. The screen-printing panel of claim 3, wherein the locking strip is at least four inches longer than the tape.

5. The screen-printing panel of claim 1, wherein the stitching includes an upper stitching penetrating the locking strip and securing the mesh to the first surface of the locking strip and a lower stitching securing the mesh to the second surface of the locking strip.

6. The screen-printing panel of claim 5, wherein the upper stitching comprises a first color and the lower stitching comprises a second color.

7. The screen-printing panel of claim 1, wherein the locking strip is at least four inches longer than the stitching.

8. The screen-printing panel of claim 1, wherein the uncoated region of the locking strip is greater than about four inches.

9. A method for making a screen-printing panel, the method comprising:

cutting a mesh into a rectangle having substantially straight edges;

for each edge of the mesh:

applying an adhesive to a portion of a first surface of a locking strip, the first surface proximate both ends of the locking strip having an uncoated region free of adhesive, the length of the locking strip plus four times the width of the locking strip being less than the length of the edge of the mesh;

attaching the first surface of the locking strip to a first portion of the mesh along the edge of the mesh using the adhesive;

folding the mesh around an edge of the attached locking strip to position a second portion of the mesh adjacent to a second surface of the locking strip;

sewing the first and second portion of the folded mesh to the first and second surfaces of the locking strip, respectively, using stitching through the first and second portion of the mesh and through locking strip, the length of the stitching being less than the length of the locking strip to provide a region of the first and second surface free of stitching at both ends of the locking strip; and providing a gap between both ends of each locking strip and an adjacent corner of the rectangular mesh.

10. The method of claim 9 wherein the stitching includes an upper stitching having a first color and a lower stitching having a second color.

11. The method of claim 9, wherein the adhesive or the locking strip is color-coded.

12. The method of claim 9, wherein the length of the locking strip is at least two inches less than the length of the edge of the mesh.

13. The method of claim 9, wherein the uncoated region of the locking strip is greater than one inch.

* * * * *